US006916240B1

(12) United States Patent
Morton

(10) Patent No.: US 6,916,240 B1
(45) Date of Patent: Jul. 12, 2005

(54) VENTING SYSTEM

(75) Inventor: Steven J. Morton, 20438 N. 36th Dr., Glendale, AZ (US) 85308

(73) Assignee: Steven J. Morton, Glendale, AZ (US)

( * ) Notice: Subject to any disclaimer, the term of this patent is extended or adjusted under 35 U.S.C. 154(b) by 69 days.

(21) Appl. No.: 10/236,301

(22) Filed: Sep. 6, 2002

Related U.S. Application Data

(60) Provisional application No. 60/318,847, filed on Sep. 10, 2001.

(51) Int. Cl.[7] ..... F24F 13/65

(52) U.S. Cl. ..... 454/286; 454/326

(58) Field of Search ..... 454/154, 286, 454/326, 336; 251/250, 250.5, 353

(56) References Cited

U.S. PATENT DOCUMENTS 1,659,880 A * 2/1928 Kauffman ..... 454/323
2,790,375 A * 4/1957 Broberg ..... 454/326
3,010,381 A * 11/1961 Glass ..... 454/336
3,572,233 A * 3/1971 Bar et al. ..... 454/154
3,802,328 A * 4/1974 Kakizaki ..... 454/154
3,835,759 A * 9/1974 Lloyd ..... 454/154
4,006,673 A * 2/1977 Meyer et al. ..... 454/154
5,863,310 A * 1/1999 Brown et al. ..... 55/480
6,241,794 B1 * 6/2001 Jadran et al. ..... 55/490

* cited by examiner

*Primary Examiner*—Harold Joyce
(74) *Attorney, Agent, or Firm*—Steven J. Morton

(57) ABSTRACT

A register system for air flow regulation, directing, damping and filtering attachable to individual building air supply outlets said as typically found in building rooms wherein air flow from a central air supply enters a room of the building through a duct in a partition of the room. The system is particularly useful for persons said as asthmatics who require additional room air filtering and special needs relating to air damping and airflow. Many of these persons find direct airflow on their person to be irritating. The present invention allows for said persons to directly (or through the use of an extendable pole) re-direct one or more individual air deflectors to aim the air in almost any direction. Furthermore, said persons may directly (or through the use of an extendable pole) adjust individual dampers in each air deflector for adjusting the air volume.

3 Claims, 6 Drawing Sheets

VENTING SYSTEM

CROSS-REFERENCE TO RELATED APPLICATION

The present application is related to applicant's prior U.S. Provisional Application No. 60/318,847, filed Sep. 10, 2001, entitled "VENTING SYSTEM", the contents of which are herein incorporated by reference and are not admitted to be prior art with respect to the present invention by their mention in this cross-reference section.

BACKGROUND

This invention relates to providing a system for improved room air flow regulation/directing, filtering and damping, preferably for a building having a central heating, ventilation, and air-conditioning system.

Typically, a residential home will have a plurality of air conditioning/heating registers, which assist in disbursing air coming from the air ducts. Such incoming supplied air may be cooled, heated, humidified, or de-humidified. Such air conditioning/heating registers typically comprise a damping means to regulate the volume of the supplied air to the room and also typically comprise one or more sets of adjustable louvers to provide flow direction of the air. Typically, such air conditioning/heating registers attach to an air-conditioning supply duct mounted into the surface of a wall, ceiling, or floor. Such air conditioning/heating registers are typically attached in a single plane, i.e. in a wall (most common), or in a floor, or in a ceiling. Additionally, the adjustable louvers typically comprise one or two sets of finned louvers in either one or two axes (typically perpendicular to one another). Due to this single-plane, perpendicular louver arrangement, only minimal adjustment of the air flow of the incoming supplied air is possible.

However, many persons, in particular asthmatics, living and working in rooms having such air conditioning/heating registers may desire, and may even actually require, the ability to adjust the air flow of the incoming air to the room to a greater degree and accuracy both in regards to placement and flow than is possible using a typical air conditioning/heating register. Therefore, a need exists for an air conditioning/heating register system that attaches to a standard air-conditioning supply duct and provides up to a substantially a 360-degree range of directional rotation to the louvers to direct the air flow, preferably in a plane that is substantially parallel to the plane of the surface containing the supply duct. Additionally, a need exists for a register system that attaches to a standard air-conditioning supply duct and that also, integral to the register system, provides an air flow directional control assembly whereby the air flow of the supplied air to the room is directed by up to a 360-degree range of directional rotation to the louvers to direct the air flow. Furthermore a need exists for a register system that attaches to a standard air-conditioning supply duct and that also, integral to the register system, provides a full range of air-flow volume control dampening from zero to maximum flow. Furthermore, a need exists for a register system that attaches to a standard air-conditioning supply duct and that also, integral to the register system, provides a filtration assembly for the reduction of airborne particulate, particularly to provide improved filtering of an asthmatic's room.

OBJECTS OF THE INVENTION

A primary object and feature of the present invention is to provide an air conditioning/heating register system that attaches to a standard air-conditioning supply duct and provides up to a substantially a 360-degree range of rotation to the louvers to direct the air flow.

It is a further primary object and feature of the present invention to provide such a register system that attaches to a standard air-conditioning supply duct and that also, integral to the register system, provides an air flow directional control assembly whereby the air flow of the incoming supplied air is directed with up to a 360-degree range of directional rotation to the louvers to direct the air flow and also provides for tilting of the direction of the incoming flow to further direct it to downwardly, upwardly, or to either side.

It is another primary object and feature of the present invention to provide such a register system that attaches to a standard air-conditioning supply duct and that also, integral to the register system, provides a full range of air-flow volume control dampening from zero to maximum flow.

Yet another primary object and feature of the present invention to provide such a register system that attaches to a standard air-conditioning supply duct and that also, integral to the register system, provides a filtration assembly for the reduction of airborne particulate.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a register system for managing air flow through a building air supply outlet wherein air flow from a central air supply enters a room of the building through a duct having an aperture situate in a partition of the room, comprising: first housing means for connecting the register system with the duct aperture; wherein such first housing means comprises face plate means for covering areas of intersection of the duct aperture and the partition; air directing means for directing the air flow; and second housing means for holding such air directing means; wherein such second housing means is rotatably mountable to such first housing means; and wherein such register system is structured and arranged so that the air flow may be directed, by rotation of such second housing means to a selected position among a plurality of positions within an approximate 360-degree arc, to a multitude of locations within the room.

It also provides such a system further comprising damping means, for situation within the duct, for damping air flow volume before the air flow enters such air directing means. And, it provides such a system wherein such damping means further comprises incremental means, controllable by a user, for incremental damping. Further, it provides such a system further comprising filtering means for filtering, within the duct, unwanted particulates from the air flow. It also provides such a system further comprising filtering means for filtering, within the duct, unwanted particulates from the air flow. Even further, it provides such a system further comprising hinge means for hingeably connecting the register system with the duct aperture.

In accordance with another preferred embodiment hereof, this invention provides a register system for managing air flow through a building air supply outlet wherein air flow from a central air supply enters a room of the building through a duct having an aperture situate in a partition of the room, comprising: a butterfly damping means, adjacent the duct aperture, for damping the air flow; wherein such butterfly damping means comprises, rotating blocking means for incrementally blocking the air flow, gear means for rotating such blocking means, and actuator means for actuating such gear means.

Moreover, it also provides such a system further comprising filtering means for filtering unwanted particulates from the air flow. And, it provides such a system further comprising tilter means for tilting, with respect to such first housing means, such second housing means in substantially all directions.

In accordance with still another preferred embodiment hereof, this invention provides a register system for managing air flow through a building air supply outlet wherein air flow from a central air supply enters a room of the building through a duct having an aperture situate in a partition of the room, comprising: a first housing structured and arranged to connect the register system with the duct aperture; wherein such first housing comprises a face plate structured and arranged to cover areas of intersection of the duct aperture and the aperture; at least one air director structured and arranged to direct the air flow; and at least one second housing structured and arranged to hold such at least one air director; wherein such at least one second housing is rotatably mountable to such first housing; wherein such register system is structured and arranged so that the air flow may be directed, by rotation of such second housing to a selected position among a plurality of positions within an approximate 360-degree arc, for directing the air flow to a multitude of locations within the room.

Additionally, it also provides such a system further comprising at least-one damper, situate within the duct, structured and arranged to damp air flow volume before the air flow enters such at least one air director. And, it provides such a system wherein such damper further comprises at least one adjuster, controllable by a user, structured and arranged to provide incremental damping. Further, it provides such a system further comprising at least one filter, within the duct, structured and arranged to filter unwanted particulates from the air flow. Even further, it provides such a system further comprising at least one hinge structured and arranged to hingeably connect the register system with the duct aperture. It also provides such a system wherein such second housing is structured and arranged to tilt, with respect to such first housing, such second housing in substantially all directions.

In accordance with yet another preferred embodiment hereof, this invention provides a register system for managing air flow through a building air supply outlet wherein air flow from a central air supply enters a room of the building through a duct having an aperture situate in a partition of the room, comprising: at least one butterfly damper, adjacent the duct aperture, structured and arranged to damp the air flow; wherein such at least one butterfly damper comprises, at least one rotating blocker structured and arranged to incrementally block the air flow, at least one gear system structured and arranged to rotate such at least one rotating blocker, and at least one actuator system structured and arranged to actuate such at least one gear system.

Furthermore, it also provides such a system further comprising at least one filter structured and arranged to filter unwanted particulates from the air flow. It also provides such a system wherein: such rotating blocker comprises two mirror-image semi-circle halves wherein each such respective half comprises a spindle, having a central axis, attached along the diameter of such semi-circle halt; such gear system comprises two substantially circular gears, each having a central axis and a set of first gear teeth, each attached to a respective end of each such spindle; wherein each such respective spindle and each respective such attached gear is structured and arranged to attach to the other such respective spindle and respective such attached gear so that each such respective spindle and respective such attached gear have the same central axis, such actuator system comprises a set of upper linear second gear teeth, and a set of lower linear second gear teeth, wherein each such set of upper linear second gear teeth are structured and arranged to turn one such gear in a first rotational direction when moved linearly in a first linear direction and each such set of lower linear second gear teeth are structured and arranged to turn the other such gear in a second rotational direction when moved linearly in such first linear direction, wherein linear movement of an actuator comprising both such sets of linear gear teeth in a first linear direction provides rotational movement of such semi-circle halves sufficient to operate such butterfly damper.

In accordance with yet another preferred embodiment hereof, this invention provides a damping system for managing fluid flow through a conduit, comprising: at least two damper elements structured and arranged to damp the fluid flow when such damper elements are rotated in opposed directions; wherein such damping system comprises at least one gear system and at least one actuator system and wherein such damper elements comprises two mirror-image halves wherein each such respective half comprises a spindle, having a central axis, attached along a side of such half; such gear system comprises two substantially circular gears, each having a central axis and a set of first gear teeth, each attached to a respective end of each such spindle; wherein each such respective spindle and each respective such attached gear is structured and arranged to attach to the other such respective spindle and respective such attached gear so that each such respective spindle and respective such attached gear have the same central axis, such actuator system comprises a set of upper linear second gear teeth, and a set of lower linear second gear teeth, wherein each such set of upper linear second gear teeth are structured and arranged to turn one such gear in a first rotational direction when moved linearly in a first linear direction and each such set of lower linear second gear teeth are structured and arranged to turn the other such gear in a second rotational direction when moved linearly in such first linear direction, wherein linear movement of an actuator comprising both such sets of linear gear teeth in a first linear direction provides rotational movement of such halves sufficient to operate such damper elements.

It also provides such a system wherein further comprising: handle adjustment means for moving such damping means and such second housing means by a user from a distance from such register system.

DETAILED DESCRIPTION OF A PREFERRED EMBODIMENT OF THE INVENTION

Figure 1:
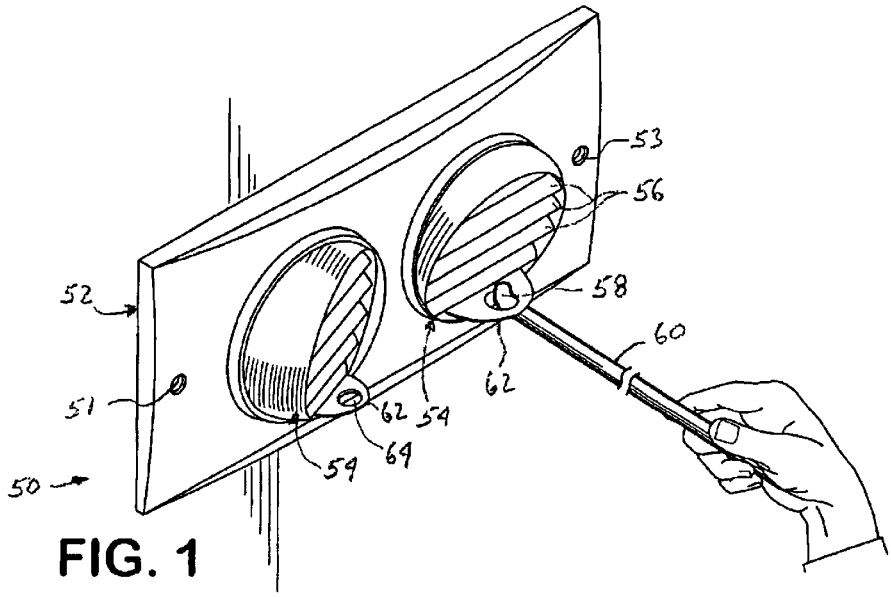
FIG. 1 is a perspective view of the venting system according to a preferred embodiment of the present invention.
Figure 2:
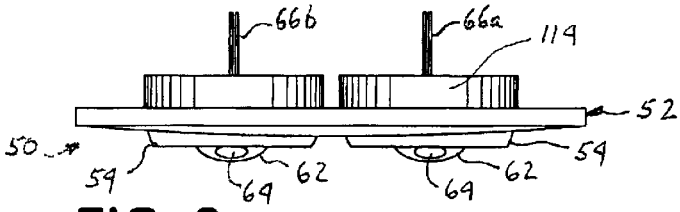
FIG. 2 is a plan view of the venting system according to a preferred embodiment of the present invention.
Figure 3:
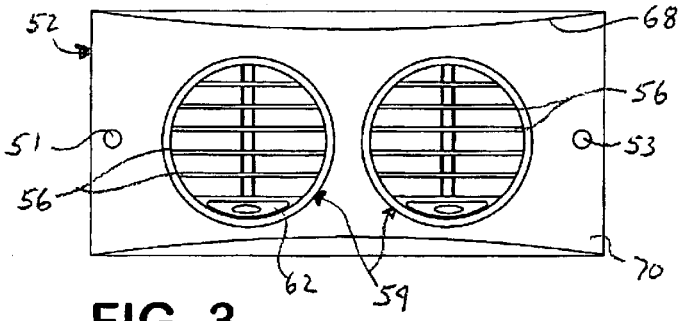
FIG. 3 is a front view of the venting system according to a preferred embodiment of the present invention.
Figure 18:
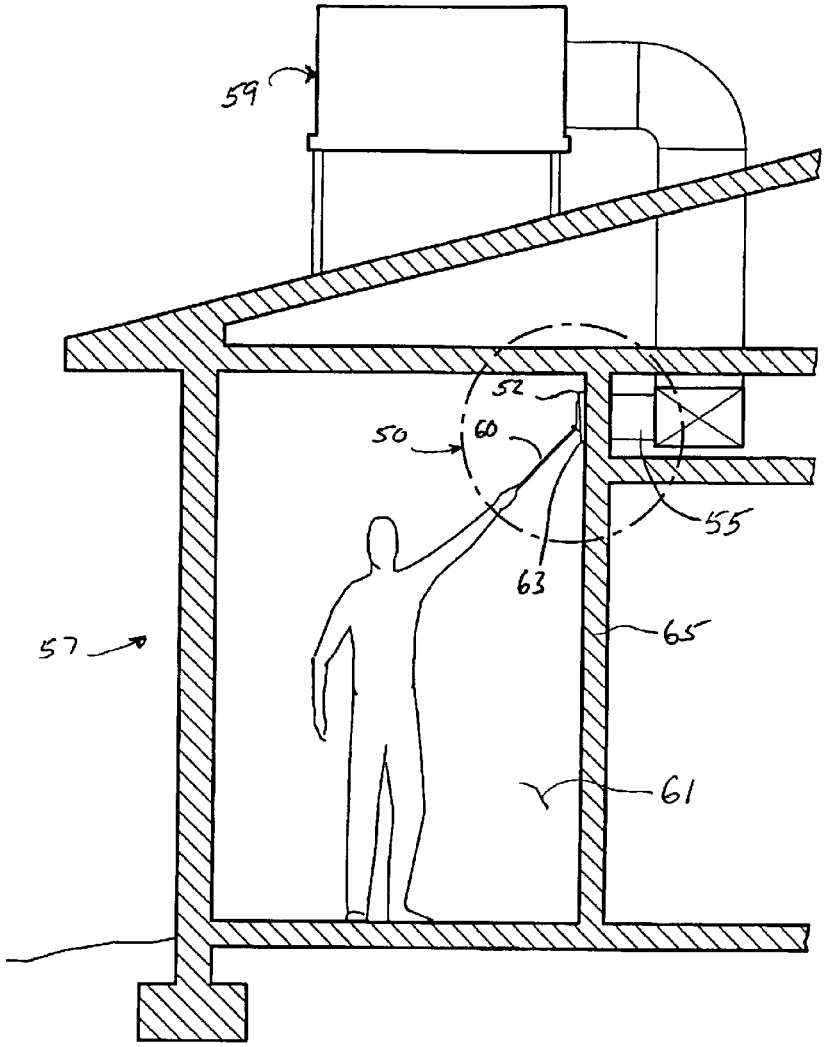
FIG. 18 is a perspective view of the venting system in use according to a preferred embodiment of the present invention.

Referring now to the drawings, FIG. 1 is a perspective view of the venting system 50 according to a preferred embodiment of the present invention. FIG. 18 is a perspective view of the venting system 50 in use according to a preferred embodiment of the present invention. FIGS. 1 and 18 illustrate generally a register system according to the present invention for managing air flow through a building air supply outlet wherein air flow from a central air supply enters a room of the building through a duct having an aperture situate in a partition of the room. The venting system 50 comprises a first housing (comprising a faceplate) 52 which preferably attaches to a standard air-conditioning supply duct 55 (also referred to herein as an HVAC duct—this includes heating ducts, venting ducts and cooler ducts generally sized and used in a similar manner) in a residential building 57 or similar building. Preferably, the venting system 50 is utilized for managing air flow through a building HVAC supply duct 55 wherein air flow from a central air supply 59 enters a room 61 of the building 57 through a duct 55 having an opening 63 situate in a partition 65 of the room 61. Preferably, the first housing 52 attachment is through apertures 51 and 53 which align with typical screw holes in the air-conditioning supply duct 55. Preferably, first housing 52 supports, as shown herein, two second housings 54. Preferably, each second housing 54 comprises an air directing system (sometimes hereinafter called an air director) comprising a plurality of louvers or air directors 56, as shown, preferably parallel to each other, and preferably fixed in position, as shown. Under appropriate circumstances, other arrangements may suffice. Preferably, the second housings 54 may be rotated in a 360-degree manner to be rotated up to, for example a 360-degree circle), or tilted up, down, left, right, etc., within their mounting collars within the first housing 52 as will be further described below. Preferably, the second housings 54 may be further adjusted utilizing a hook 58 or other appropriate device attached to an extension device 60. Under appropriate circumstances other arrangements may suffice. Preferably, hook 58 positions adjuster 62 by the coupling of hook 58 to or within aperture 64, as shown. Movement of the hook 58 within the aperture 64 also enables the second housing 54 to be rotated through its 360-degree circle (or any other arc). In addition, each adjuster 62 preferably assists in controlling a respective damper 66 via the inward and outward selectable movement of the adjuster 62. Preferably, damper 66 variably and smoothly controls the volume of air flow through each respective second housing 54. Referring to FIG. 2, a plan view of the venting system 50 is shown that further illustrates the extension of the dampers 66 out the backside of the first housing 52. Referring to FIG. 3, a front view of the venting system 50 is shown.

Figure 4:
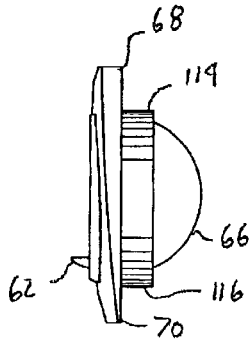
FIG. 4 is a side view of the venting system according to a preferred embodiment of the present invention.

With reference to FIG. 4, a side view of the venting system 50 according to a preferred embodiment of the present invention is shown. It is noted that first housing 52 is preferably manufactured such that the top, or upper, portion 68 is slightly wider than the bottom, or lower, portion 70 (also shown in FIG. 10) so that the second housings 54 are slightly angled downward. This angling preferably assists in providing the second housings 54 with an increased directional air flow control downward, where the air would be most likely to be directed. Preferably, the second housings 54 angle downward at about a ten-degree angle from horizontal. Under appropriate circumstances other arrangements may suffice.

Figure 5:
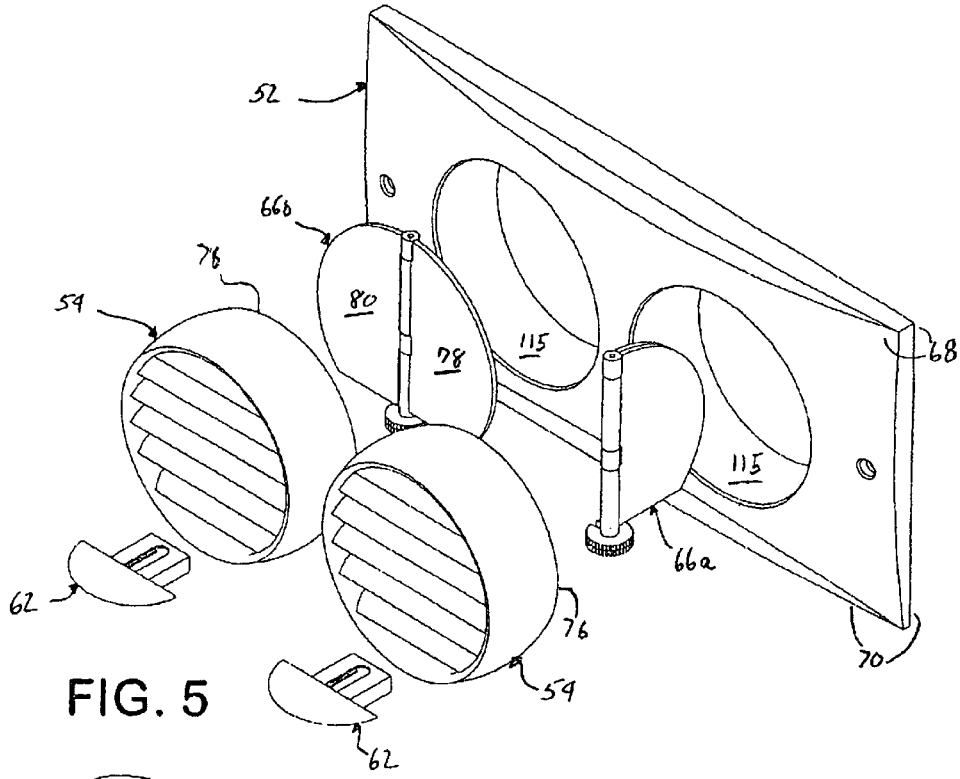
FIG. 5 is an exploded perspective view of the venting system, from the front side, according to a preferred embodiment of the present invention.

Referring to FIG. 5, an exploded perspective view of the venting system 50 according to a preferred embodiment of the present invention is shown. FIG. 5 more clearly illustrates the assembly of the second housings 54 and their respective dampers 66. As shown dampers 66 are adjustable between the full open position (shown by damper 66*a*, indicating the air flow supply is at its fully available flow) and the full closed position (shown by damper 66*b*, indicating the air flow supply is fully unavailable or shut off). The adjusters 62 are also shown positioned in front of each director 54. Each adjuster 62 inserts through its respective adjuster aperture 72 and 74 (shown from the reverse side in FIG. 10) in order to facilitate adjustment of each respective damper 66.

Figure 10:
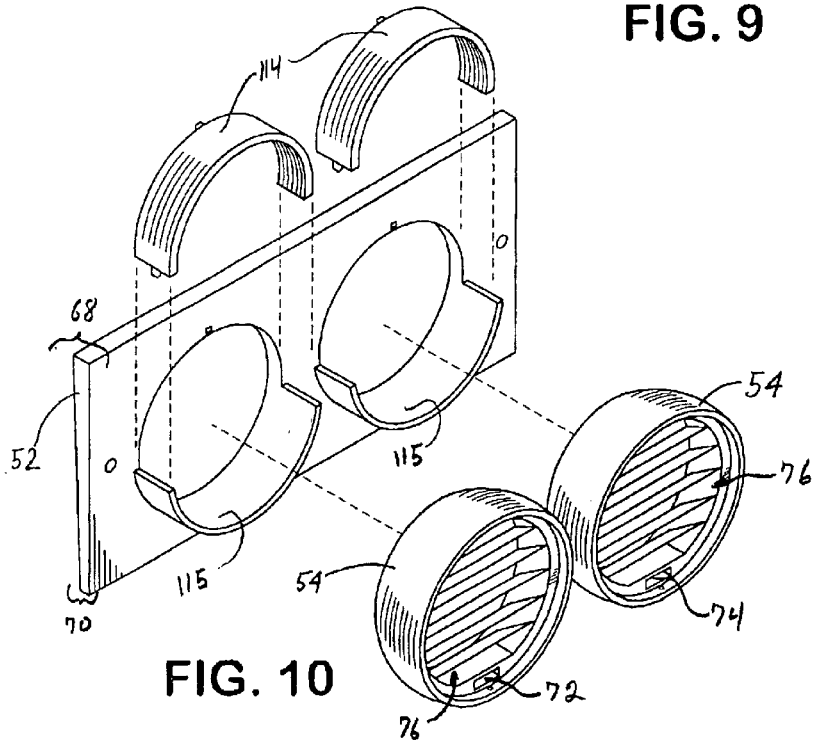
FIG. 10 is an exploded perspective view, from the back side, of the baffle assembly of the venting system according to a preferred embodiment of the present invention.
Figure 11:
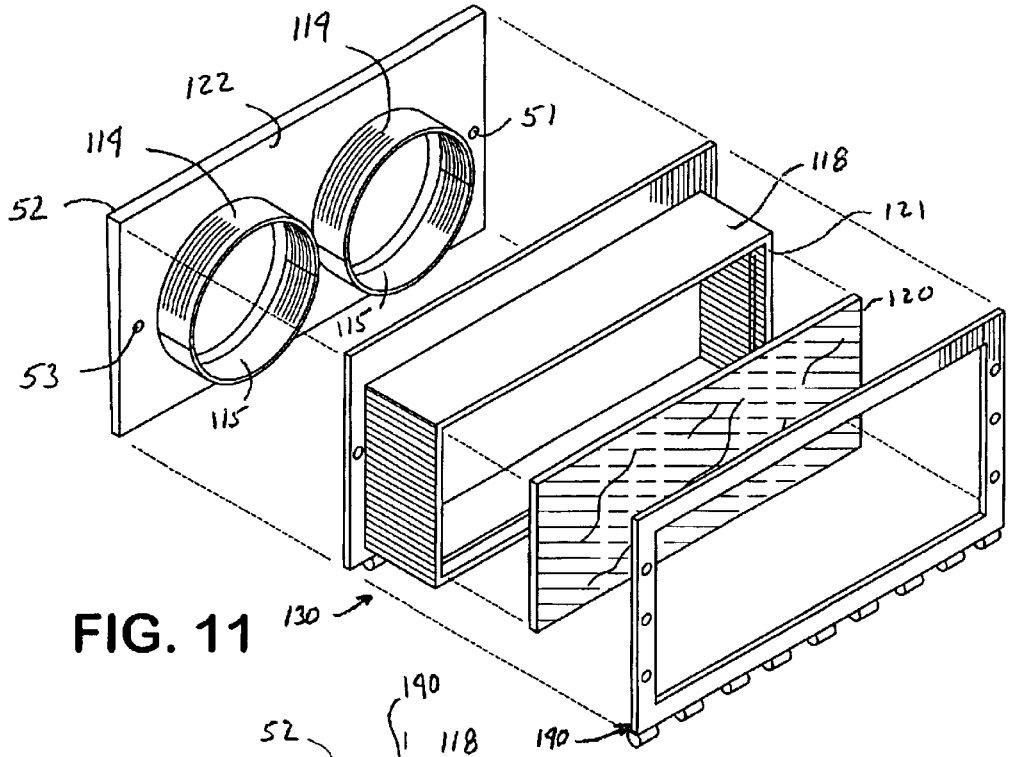
FIG. 11 is an exploded perspective view, from the back side, of a filter system of the venting system according to a preferred embodiment of the present invention.

With further reference to FIGS. 10 and 11, it may be seen that first housing 52 preferably comprises two apertures defined by mounting collars having upper and lower half collars 114 and 115. Preferably, each set of upper and lower half collars 114 and 115 are structured to allow second housings 54 to be movably housed such that each second housing 54 may be rotated laterally in a full circle and/or tilted up, down, right, left, etc. To facilitate this, it is a preferable feature of a preferred embodiment of the present invention that each of the second housings 54 is annular-shaped, as shown, such that each second housing 54 can easily rotate within each respective upper and lower half collars 114 and 115, such upper and lower half collars 114 and 115 also having inner surface dimensions that are also annular-shaped that hold their respective second housings 54 snugly within their embrace while also allowing free rotation. As shown, the matching surfaces of the exterior of second housings 54 and the interiors of the half-collars 114 and 115 are spherical so as to permit tilting/swiveling to a degree (as well as rotation) while still holding such housings in place. Thus, each respective second housing 54 has as a feature the property of being able to rotate or tilt/swivel transverse to its radial movement such that each respective second housing 54 can tilt/swivel about 45 degrees in any direction. It is noted that although the presently discussed embodiment of the present invention comprises two second housings 54, those skilled in the art will recognize that under appropriate circumstances only one, or more than two, second housings 54 might be comprised within the venting system 50.

With further reference to FIGS. 5–9, as shown, each respective second housing 54 preferably is associated with (as shown) a damper 66. Each damper 66 is preferably located at the rear 76 of each respective second housing 54 (see FIG. 5 in particular.) Preferably damper 66 is a butterfly-type damper comprising two semi-circle halves 78 and 80. Preferably, each respective half 78 and 80 operates independently through a gear and spindle arrangement, as shown.

Figure 6:
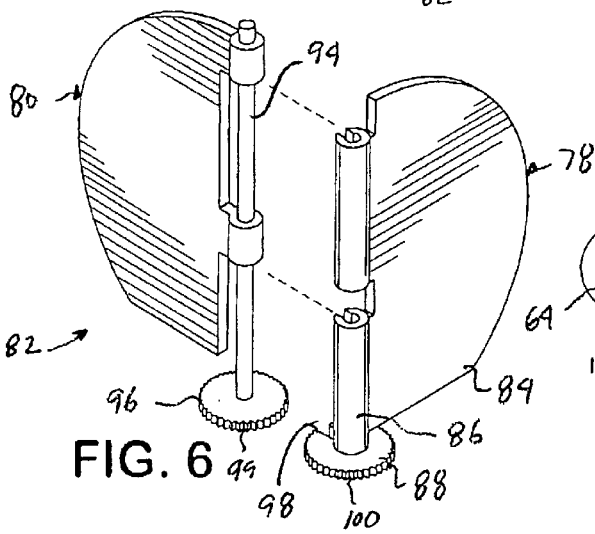
FIG. 6 is a perspective view of a single damping assembly of the venting system according to a preferred embodiment of the present invention.

With reference to FIG. 6, a perspective view of a single damping assembly 82 of the venting system 50 according to a preferred embodiment of the present invention is shown. Each of the dampers 66 comprises a damping assembly 82. Further reference is also made to FIG. 7 which shows an exploded perspective view of an adjuster 62 used to operate the damping assembly 82. The damping assembly 82 preferably comprises, as shown, the semi-circle half 80 attached to a spindle 94, which is further coupled to gear 96. Gear 96 also comprises gear teeth 99 as shown. The damping assembly 82 preferably comprises the second semi-circle half 78. The semi-circle half 78 is preferably attached to comprises a spindle 86 structured and arranged to hingedly (i.e., one spindle comprises a bar and the other comprises a "mating" hollow cylinder) mate with spindle 94, as shown. The spindle 86 preferably further comprises a gear 88 that preferably comprises gear teeth 100, as shown. It is noted that gear 88 preferably comprises a slot 98 extending through to its center to facilitate the hinged mating of the spindle 86 with spindle 94 by enabling the gear 88 to sit atop gear 96 and rotate around spindle 86. It is further noted that the arrangement of slot 98 is such that the gear teeth 100 will fully engage the adjuster 62 as will be further explained below with reference to FIGS. 7–9.

Figure 7:
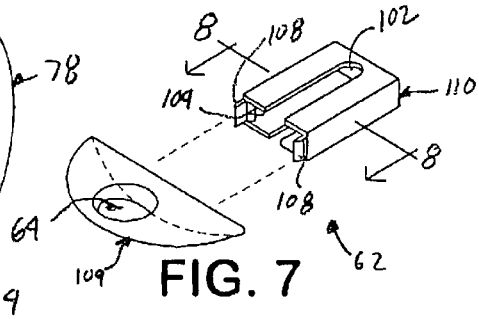
FIG. 7 is an exploded perspective view of a single damping assembly adjuster according to a preferred embodiment of the present invention.
Figure 8:
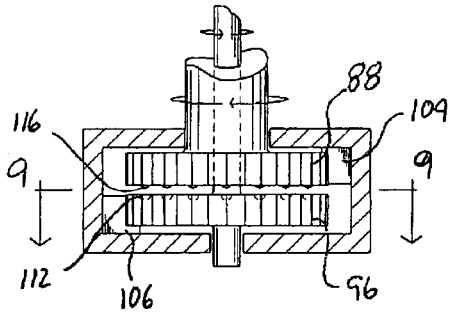
FIG. 8 is a sectional view through section 8—8 of FIG. 7.
Figure 9:
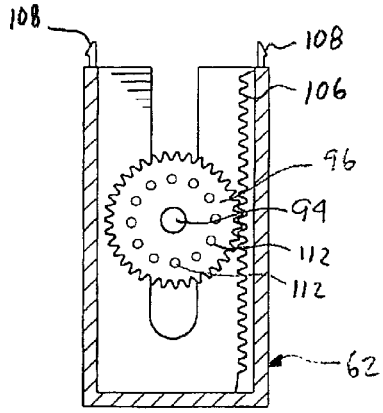
FIG. 9 is a sectional view through section 9—9 of FIG. 8.

FIG. 7 is an exploded perspective view of a single damping assembly adjuster according to a preferred embodiment of the present invention, FIG. 8 is a sectional view through section 8—8 of FIG. 7, and FIG. 9 is a sectional view through section 9—9 of FIG. 8. Preferably, adjuster 62 comprises two sections, a slotted section 110 and a capped section 112. Preferably, slotted section 110 has a slot 102 which slidably fits around spindle 86. Additionally, the pair of gears 88 and 100 slide within the interior of the slotted section 110. Preferably, section 110 further comprises a set of upper linear gear teeth 104 which will match-up and align with the gear teeth 100 and a set of lower linear gear teeth 106 which will match-up and align with the gear teeth 99 as further described, as follows. With reference to FIG. 8, upper linear gear teeth 104 are preferably positioned within the section 110 such that the upper linear gear teeth 104 engage the gear teeth 100 of gear 88 only, and the lower linear gear teeth 106 are positioned within the section 110 such that the lower linear gear teeth 106 engage the gear teeth 99 of gear 96 only. Preferably, the above described arrangement provides that movement of the section 110 in a forward or reverse direction will move each respective half 78 and 80 independently and in opposite directions, thereby providing a butterfly type movement of the damper 66.

Preferably, slotted section 110 further comprises tabs 108 which assist in connecting slotted section 110 to capped section 109 (comprised by adjuster 62). Preferably, capped section 109 has a matching tab-locking connection to the tabs 108 of slotted section 110 (this type of tab and locking connections being well known by those knowledgeable in such art). Preferably, capped section 109 is attached to slotted section 110 after insertion of the gear teeth 100 and 104 into slotted section 110. Preferably, gear 96 further comprises a plurality of hemispherical dimples 112 spaced at equal distances along the top 114 of the gear 96, as shown in FIG. 8. Preferably, gear 88 comprises a plurality of hemispherical protrusions 116 that are located and spaced at equal distances along the side of gear 88 facing the gear 96, as shown in FIG. 8. Preferably, the hemispherical dimples 112 align with the hemispherical protrusions 116 such that when the gears 88 and 96 are rotated, each respective hemispherical protrusions 116, when aligned with a respective hemispherical dimples 112, fits into the hemispherical dimples 112 and provides resistance to further movement of the gears 88 and 96. Such resistance is needed to keep the damper 66 from shutting when partially open or closed due to air flow which may be pushing against the semi-circle halves 78 and 80 when the venting system 50 is in operation. It should be noted that the amount of the hemispherical protrusions 116 and the respective hemispherical dimples 112 is variable as may be considered appropriate by those skilled in the art. Under appropriate circumstances other arrangements may suffice.

Preferably, in the above described embodiment and as shown in FIG. 8, as adjuster 62 is pulled outward away from the first housing 52 the hollow spindle 86 and attached gear 88 turn in a clockwise direction (relative to the upper section 68 and looking down), and the semi-circle half 78 rotates such that it incrementally blocks air flow through its respective second housing 54. Simultaneously with the action of the gear 88 and the semi-circle half 78, as adjuster 62 is pulled outward away from the first housing 52 the spindle 94 and attached gear 96 turn in a counter-clockwise-direction (relative to the upper section 68 and looking down), causing the semi-circle half 80 to rotate such that it incrementally blocks air flow through its respective second housing 54. Preferably, as both of the semi-circle halves 78 and 80 are simultaneously operated the flow of air through each respective second housing 54 is smoothly adjusted or throttled. Preferably, a feature of the above described embodiment of the present invention is that a user may easily and smoothly adjust the volume of the air flow through each respective second housing 54. Preferably, as each damping assembly 82 is coupled to the rear 76 of its respective second housing 54, as each second housing 54 is rotated around each of its respective horizontal, vertical and radial axis, the associated damping assembly 82 moves in unison with it.

It is noted that the above-described damping arrangement is useful generally in damping fluid flow through conduits. Thus, this arrangement embodies herein a damping system for managing fluid flow through a conduit, comprising: at least two damper elements structured and arranged to damp the fluid flow when such damper elements are rotated in opposed directions; wherein such damping system comprises at least one gear system and at least one actuator system and wherein said damper elements comprises two mirror-image halves wherein each such respective half comprises a spindle, having a central axis, attached along a side of such half; said gear system comprises two substantially circular gears, each having a central axis and a set of first gear teeth, each attached to a respective end of each such spindle; wherein each such respective spindle and each respective such attached gear is structured and arranged to attach to the other such respective spindle and respective such attached gear so that each such respective spindle and respective such attached gear have the same central axis, said actuator system comprises a set of upper linear second gear teeth, and a set of lower linear second gear teeth, wherein each such set of upper linear second gear teeth are structured and arranged to turn one such gear in a first rotational direction when moved linearly in a first linear direction and each such set of lower linear second gear teeth are structured and arranged to turn the other such gear in a second rotational direction when moved linearly in such first linear direction, wherein linear movement of an actuator comprising both such sets of linear gear teeth in a first linear direction provides rotational movement of such halves sufficient to operate such damper elements.

Figure 12:
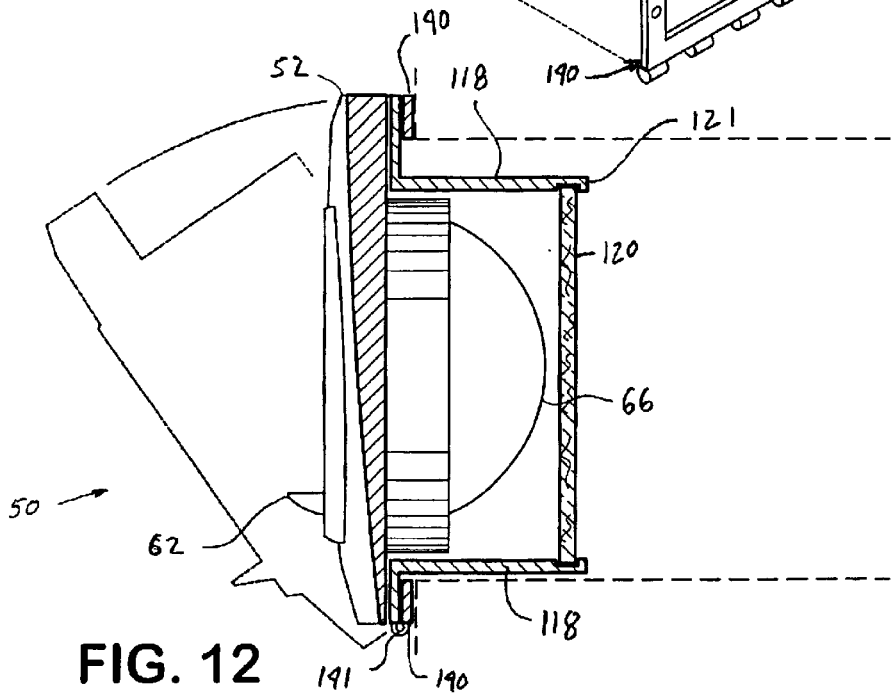
FIG. 12 is a side view, partially in section, of the filter system of FIG. 11 according to a preferred embodiment of the present invention.

With reference to FIG. 11, an exploded perspective view, from the back side, of a filter system 130 for the venting system 50 according to a preferred embodiment of the present invention is shown. With reference to FIG. 12, a side view partially in section of the filter system 130 of FIG. 11 according to a preferred embodiment of the present invention is shown. Preferably, in this embodiment, the venting system 50 further comprises a ventilation filter box 118 that is coupled to the backside of the first housing 52. As shown in FIG. 12, the depth of the filter box 118 is preferably greater than the protrusion of damper 66 when in the full open position (shown by damper 66*a*, indicating the air flow supply is at its fully available flow). Preferably, removably coupled to the back end 121 of the filter box 118 is a section of air particulate filter media 120 that provides the feature of providing a filtration assembly for the reduction of airborne particulate. Such filter media 120 may be chosen for specific applications as would be appropriate. E.g., a particular media may be sized for pollen while another may be chosen for other filtration properties such as dust. Further yet, filter media 120 preferably may comprise an electrostatic, or electrically charged media for enhanced removal of pollen and other particulate. It should be noted that under appropriate conditions, such filter media 120 might also remove smoke and odors which would preferably enhance the effectiveness of the venting system 50. Preferably, the venting system 50, including its filter box 118, is sized to fit within the confines of a standard air-conditioning supply duct 124, or venting duct. Preferably, such air-conditioning supply ducts 124 come in a plurality of sizes and the venting system 50 of the present invention will be preferably sized as desired in order to fit within the inner dimensions of such plurality of air-conditioning supply ducts 124.

It is noted that a hinge assembly 140, comprising hinge plate 141, may be preferably used to provide a hinged way to, for example, change the filter. FIG. 11 shows the preferred location of the hinge assembly 140 and hinge plate 141. Those skilled in the art will recognize the manners in which a sliding hinge like this one may be designed and utilized.

Figure 13:
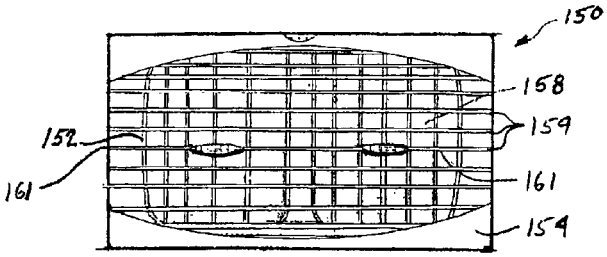
FIG. 13 is a front view of an alternate venting system according to another preferred embodiment of the present invention.

Reference is now made to FIG. 13, a front view of an alternate venting system 150 according to another preferred embodiment of the present invention. Preferably, the alternate venting system 150 comprises a substantially rectangular first housing 154. Preferably, the first housing 154 supports two louvered second housing sections 152 and 158.

Figure 14:
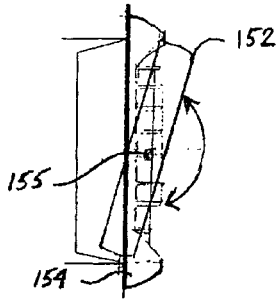
FIG. 14 is a side view, partially in section, of the alternate venting system according to another preferred embodiment of the present invention.

FIG. 14 is a side view, partially in section, of the alternate venting system 150 according to another preferred embodiment of the present invention. The two louvered second housing sections 152 and 158 are structured such that they may pivot about separate horizontal axis. Shown herein as a sectional view, is louvered second housing section 152 rotated out of the substantially vertical plane of the first housing 154 about a pivot point 155.

Figure 15:
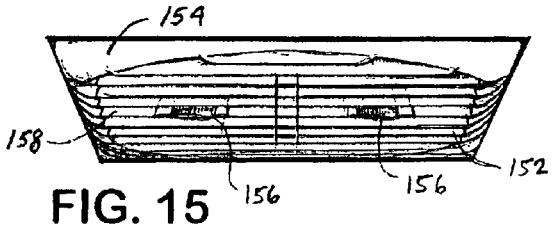
FIG. 15 is an overhead perspective view of the alternate venting system according to another preferred embodiment of the present invention.
Figure 16:
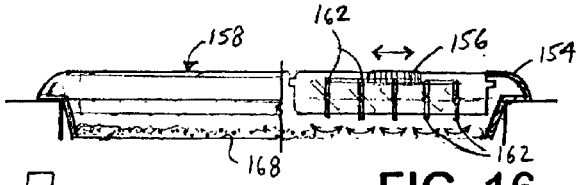
FIG. 16 is an overhead view, partially in section, of the alternate venting system according to another preferred embodiment of the present invention.

Referring to FIG. 15, an overhead perspective view of the alternate venting system 150 according to another preferred embodiment of the present invention is shown. As shown by this perspective drawing, the first housing 154 has a feature of being rounded and contoured in a convex fashion. Also shown in FIGS. 13 and 15 are the vertical louver adjusters 156. Each of the two louvered second housing sections 152 and 158 comprise a vertical louver adjuster 156. With reference to FIG. 16, an overhead view, partially in section, of the alternate venting system 150 according to another preferred embodiment of the present invention is shown. The two louvered second housing sections 152 and 158 are substantially identical and the following concerning the louvered second housing section 152 is thus also applicable to the louvered second housing section 158. The louvered second housing section 152 comprises a plurality of vertical air directors 162 that are coupled together and movable via a horizontal operation of the vertical air director adjuster 156. Thus, the combination of the feature of the vertical air directors 162 and the feature of the louvered second housing section 152 to rotate about the horizontal pivot point 155 provides the feature whereby the air flow of the incoming supplied air may be directed to a selected multiplicity of locations. The alternate venting system 150 further comprises a section of air particulate filter media 168 that provides the feature of providing a filtration assembly for the reduction of airborne particulate. As previously discussed and again applicable herein with reference to the alternate venting system 150, such filter media 168 may be chosen for specific applications as would be appropriate, e.g., a particular media might be sized for pollen, while another might be chosen for other filtration properties; such filter media 168 might also comprise an electrostatic, or electrically charged media; such filter media 168 might also remove smoke and odors which would enhance the effectiveness of the alternate venting system 150; etc. It is further noted that the alternate venting system 150 is sized to fit within the confines of a standard air-conditioning supply duct or venting duct. As such air-conditioning supply ducts come in a plurality of sizes, it is anticipated that the alternate venting system 150 of the present invention will be sized as desired in order to fit within the inner dimensions of such plurality of air-conditioning supply ducts.

Figure 17:
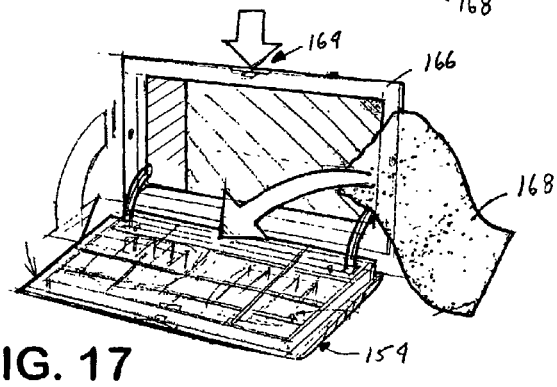
FIG. 17 is a perspective view of the alternate venting system according to another preferred embodiment of the present invention showing the venting system in the filter access configuration.

With reference to FIG. 17, a perspective view of the alternate venting system 150, according to another preferred embodiment of the present invention, showing the alternate venting system 150 in the filter access configuration is shown.

A first housing latch 164 is operated to release the first housing 154 from a support frame 166 to which it is pivotally coupled. The first housing 154 rotates open approximately 90 degrees. Thus, access to the filter media 168 is provided. It is noted that this alternate venting system 150 embodiment provides ready access to such filter media 168.

It should be noted that although the explanation above has made reference to certain planes of reference such as vertical, horizontal, etc. those skilled in the art will appreciate that under appropriate circumstances the embodiments of the present invention including the venting system 50 and the alternate venting system 150 may be mounted not only in vertical surface air-conditioning supply ducts or venting ducts (i.e. wall surfaces), but may also be mounted in horizontal surface air-conditioning supply ducts or venting ducts (i.e. floors and ceilings), and furthermore may be mounted in any air-conditioning supply ducts or venting ducts as appropriate for the installation of an embodiment of the present invention.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A register system for managing air flow through a building air supply outlet wherein air flow from a central air supply enters a room of the building through a duct having an aperture situated in a partition of the room, comprising:

a) at least one butterfly damper, adjacent the duct aperture, structured and arranged to damp the air flow;

b) wherein said at least one butterfly damper comprises, i) at least one rotating blocker structured and arranged to incrementally block the air flow, ii) at least one gear system structured and arranged to rotate said at least one rotating blocker, and iii) at least one actuator system structured and arranged to actuate said at least one gear system, c) said rotating blocker comprises two mirror-image semi-circle halves, wherein each said respective half comprises a spindle, having a central axis, attached along the diameter of said semi-circle half;

d) said gear system comprises i) two substantially circular gears, each having a central axis and a set of first gear teeth, each attached to a respective end of each said spindle;

ii) wherein each said respective spindle and each respective said attached gear is structured and arranged to attach to the other said respective spindle and respective said attached gear so that each said respective spindle and respective said attached gear have the same central axis, e) said actuator system comprises i) a set of upper linear second gear teeth, and ii) a set of lower linear second gear teeth, iii) wherein each said set of upper linear second gear teeth are structured and arranged to turn one said gear in a first rotational direction when moved linearly in a first linear direction and each said set of lower linear second gear teeth are structured and arranged to turn the other said gear in a second rotational direction when moved linearly in said first linear direction, iv) wherein linear movement of an actuator comprising both said sets of linear gear teeth in a first linear direction provides rotational movement of said semi-circle halves sufficient to operate said butterfly damper.

2. The register system according to claim 1, further comprising at least one filter structured and arranged to filter unwanted particulates from the air flow.

3. A damping system for managing fluid flow through a conduit, comprising:

a) at least two damper elements structured and arranged to damp the fluid flow when said damper elements are rotated in opposed directions;

b) wherein said damping system comprises at least one gear system and at least one actuator system and wherein i) said damper elements comprises two mirror-image halves, wherein each said respective half comprises a spindle, having a central axis, attached along a side of said half;

ii) said gear system comprises (1) two substantially circular gears, each having a central axis and a set of first gear teeth, each attached to a respective end of each said spindle;

(2) wherein each said respective spindle and each respective said attached gear is structured and arranged to attach to the other said respective spindle and respective said attached gear so that each said respective spindle and respective said attached gear have the same central axis, iii) said actuator system comprises (1) a set of upper linear second gear teeth, and (2) a set of lower linear second gear teeth, (3) wherein each said set of upper linear second gear teeth are structured and arranged to turn one said gear in a first rotational direction when moved linearly in a first linear direction and each said set of lower linear second gear teeth are structured and arranged to turn the other said gear in a second rotational direction when moved linearly in said first linear direction, (4) wherein linear movement of an actuator comprising both said sets of linear gear teeth in a first linear direction provides rotational movement of said halves sufficient to operate said damper elements.

* * * * *